United States Patent [19]

O'Connell

[11] 4,378,057

[45] Mar. 29, 1983

[54] COUPLING STRUCTURE FOR A COMPOUND DRILL STEM

[75] Inventor: James R. O'Connell, Mentor, Ohio

[73] Assignee: Mining Tools, Div. of Smith Int'l., Inc., Cleveland, Ohio

[21] Appl. No.: 238,003

[22] Filed: Feb. 25, 1981

[51] Int. Cl.[3] ..... E21B 17/04

[52] U.S. Cl. ..... 175/215; 175/320; 285/330

[58] Field of Search ..... 175/215, 320; 285/330

[56] References Cited

U.S. PATENT DOCUMENTS

| | | | |
|---|---|---|---|
| 1,455,971 | 5/1923 | Rickenbacker et al. | 285/330 |
| 2,839,315 | 6/1958 | Artebury et al. | 285/336 |
| 2,967,724 | 1/1961 | Adams | 285/330 |
| 3,664,441 | 5/1972 | Carey | 175/215 |
| 3,786,878 | 1/1974 | Clapner | 175/215 |
| 3,978,923 | 9/1976 | Ford | 175/215 |
| 4,031,970 | 6/1977 | Belknap | 175/215 |
| 4,285,408 | 8/1981 | Franks | 175/215 |

*Primary Examiner*—William F. Pate, III

*Attorney, Agent, or Firm*—Watts, Hoffman, Fisher & Heinke Co.

[57] ABSTRACT

Coupling structure to connect sections of a compound drill stem. The drill stem has concentric passages, one connected to a fluid source to provide fluid in an area being drilled and another connected to a vacuum source to carry off the fluid and accompanying cuttings from the drilling area. In the preferred embodiment, the coupling structure includes a housing with a prismatic surface that telescopically cooperates with a similarly shaped surface of at least one of the drill stem sections to effectively transmit torque through the compound stem.

2 Claims, 9 Drawing Figures

COUPLING STRUCTURE FOR A COMPOUND DRILL STEM

BACKGROUND OF THE INVENTION

This invention relates to coupling structures for compound drill stems and more particularly to coupling structures that transmit torque from one drill stem section to another in roof drills.

Roof drills are utilized for drilling holes in the ceiling of a coal mine or the like. The holes are drilled to install bolts that are cemented into the holes. The bolts secure plates to the mine ceiling to prevent rocks and earth from falling from the ceiling.

When drilling holes for roof support, hard cutting conditions are encountered and water is needed as a coolant to prolong the life of the drill bit. Certain conventional arrangements that inject water up through drill stems to drilling area are effective to cool bits during drilling, but are not favored by drill operators because they are showered with a slurry of water and cuttings and because the quantity of water required produces muddy conditions on the bottom of the mine.

One known roof drill has a drill bit cooled by water injected through its drill stem to a drilling area and also extracts the water and accompanying cuttings from the drilling area to prevent the drill operator from being showered. This known arrangement employs multiple concentric passages in its stem, connected to a water source to provide cooling water to the drilling area and is connected to a vacuum source to suck off the water and cuttings from the drilling area. Such multiple length steels are necessary because of drilling long holes in areas where seam height prevents use of a one piece steel. Connections between steel sections are difficult because of this requirement for two-way passage.

SUMMARY OF THE INVENTION

The present invention relates to a coupling structure that can be used to connect a compound drill stem for roof drilling with a water-cooled drill bit, which extracts a slurry containing cuttings from a drilling area while the drill operator is kept completely dry.

In accordance with the present invention, two drill stem sections are connected by a coupling structure. Each of the sections has concentric inner and outer pipes that provide concentric inner and outer passages for fluid flow. The coupling structure connects the outer flow passages of the two sections in fluid communication and also connects their inner passages in fluid communication. The structure has a polygonal interior cross-sectional shape that is adapted to telescopically cooperate with a similarly shaped drill stem section to transmit torque from that drill stem section through the coupling structure to another drill stem section.

In the preferred embodiment, the coupling structure has a housing with a prismatic inner surface that is polygonal (i.e. hexagonal) in cross-section. The housing is fixedly attached at one end to one of the drill stem sections while its other end is telescopically fit over a similarly shaped, prismatic (i.e. hexagonal) outer surface of the other drill stem section. Within the housing, the inner passages of each drill stem section are connected by a collar attached to one of the two inner pipes and removedly received by a sleeve attached to the other inner pipe.

By connecting the drill stem sections with a telescopic fit, the present coupling structure permits easy assembly of a compound drill stem having concentric flow passages for various seam heights in the stem. It permits easy and rapid disassembly of the compound drill stem (without complex tools) for transportation of the drill, storage of the drill, cleaning and repair of the inside of the drill stem sections. Since the telescopic coupling is achieved by a mating of two polygonal shapes, torque is effectively transmitted from a driven stem section to another stem section attached to the coupling structure. The coupling structure effectively eliminates the need for complex couplings to achieve concurrent rotation of drill stem sections having communicating, concentric flow passages.

The above and other features, objects and advantages of this invention will become more apparent as the invention becomes better understood from the detailed description that follows when considered in connection with the accompanying drawings.

DESCRIPTION OF THE PREFERRED EMBODIMENT

Figure 1:
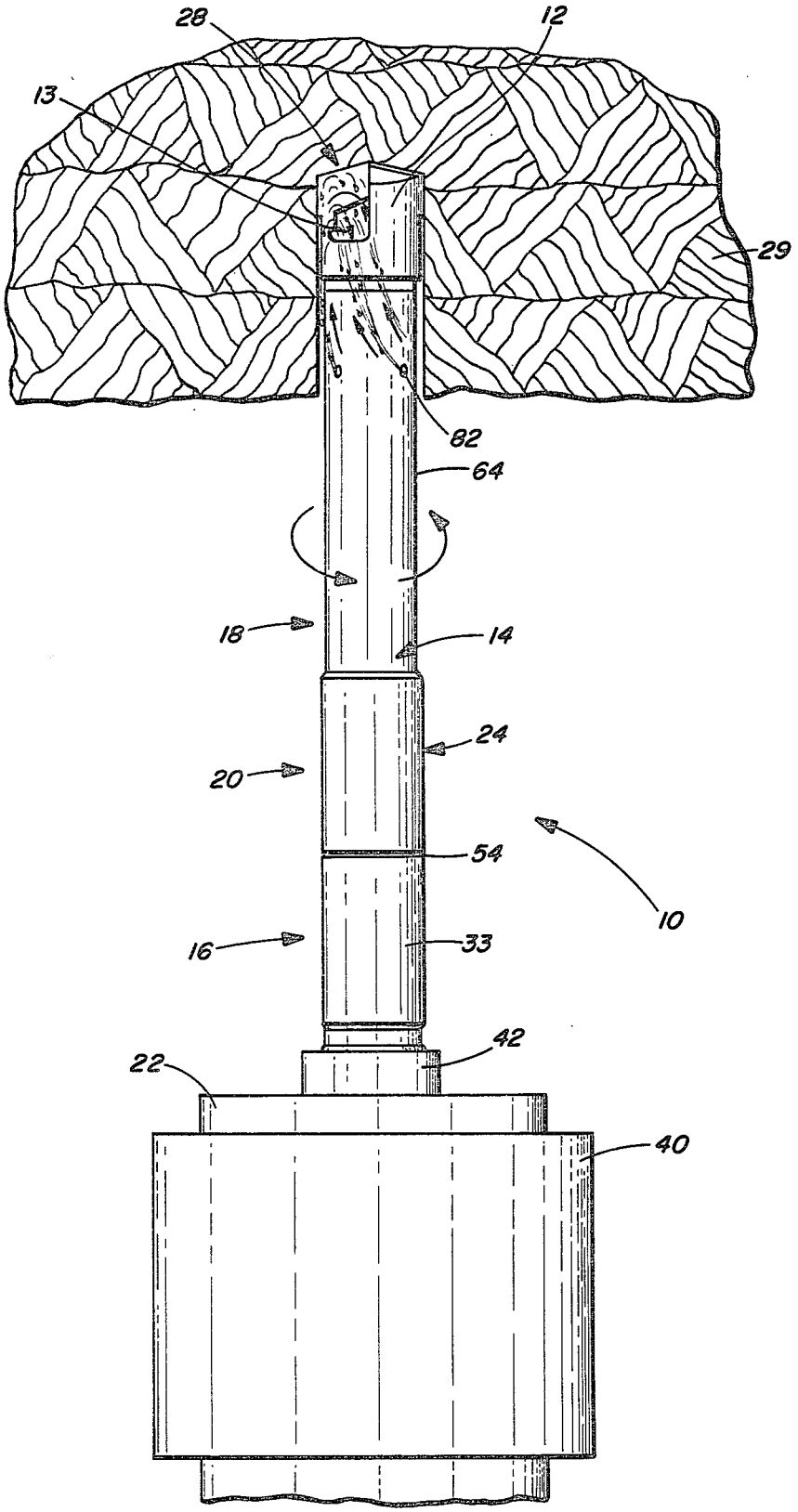
FIG. 1 is a side view, with portions broken away, of a roof drill that utilizes a coupling structure made in accordance with the present invention.
Figure 2:
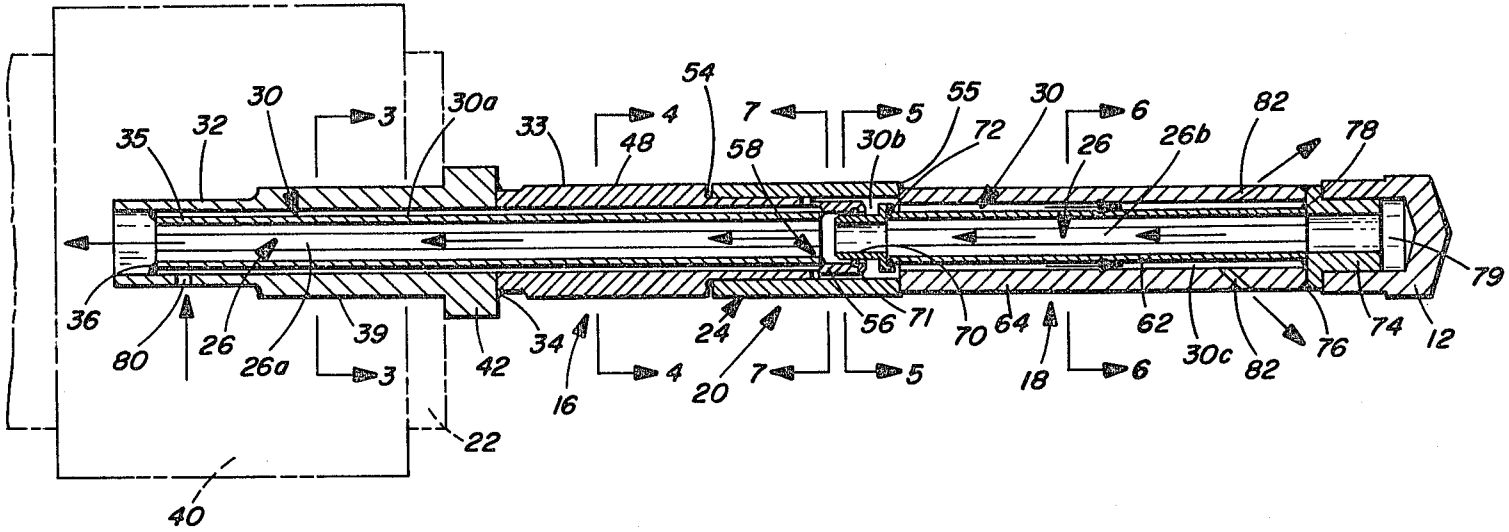
FIG. 2 is a longitudinal sectional view of a compound drill stem of the roof drill of FIG. 1, with other portions of the drill illustrated in phantom.

Referring to the drawings, a roof drill assembly 10 having a drill bit 12 attached to a compound stem 14 is shown in FIGS. 1 and 2. The compound stem 14 is defined by first and second stem sections 16, 18 that are detachably connected by a coupling structure, designated generally at 20, and rotatably attached to a rotary power means (not shown) by a drive shaft 22, as known in the art. The coupling structure 20 includes a cylindrical housing 24 that is fixedly attached at one end to stem section 18 while its other end is telescopically fit over an end portion of stem section 16. The compound stem 14 has two concentric passages (FIGS. 2 and 9) for two-way fluid flow: an outer passage 30 supplies water to a cutting area 28 of a mine roof 29 and inner passage 26 is attached to a vacuum source (not shown) to extract a slurry of the water and accompanying cuttings from the cutting area through a plurality of passages 13 in the drill bit 12. This drill bit is commercially available under the trademark "DUST HOG" from the Mining Tools Division of Smith International Inc.

Figure 3:
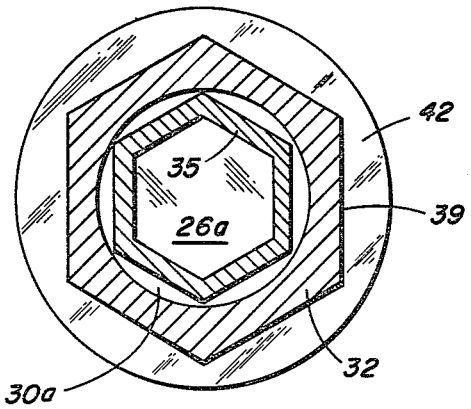
FIG. 3 is an enlarged cross-sectional view of a first drill stem section of the roof drill taken along lines 3—3 of FIG. 2.
Figure 9:
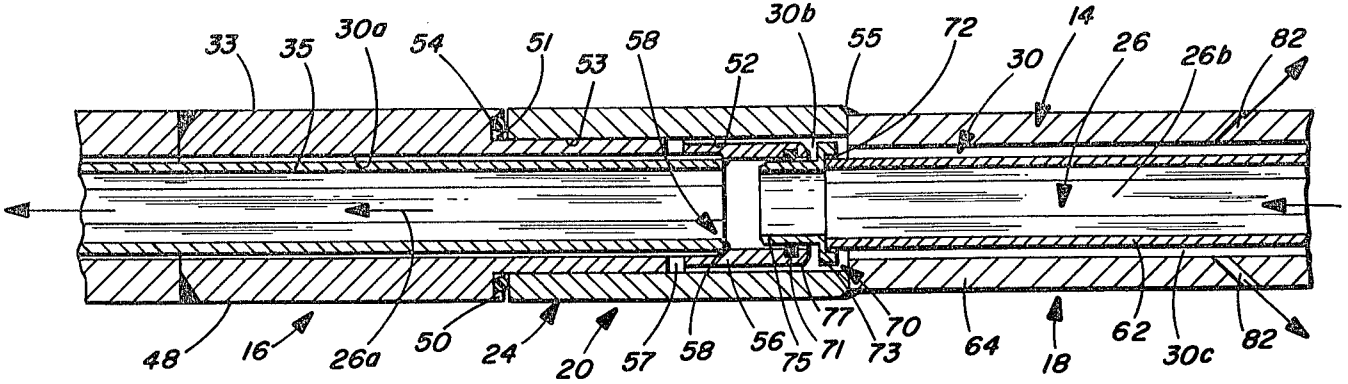
FIG. 9 is a fragmentary section view taken along the line 9—9 of FIG. 8.
Figure 8:
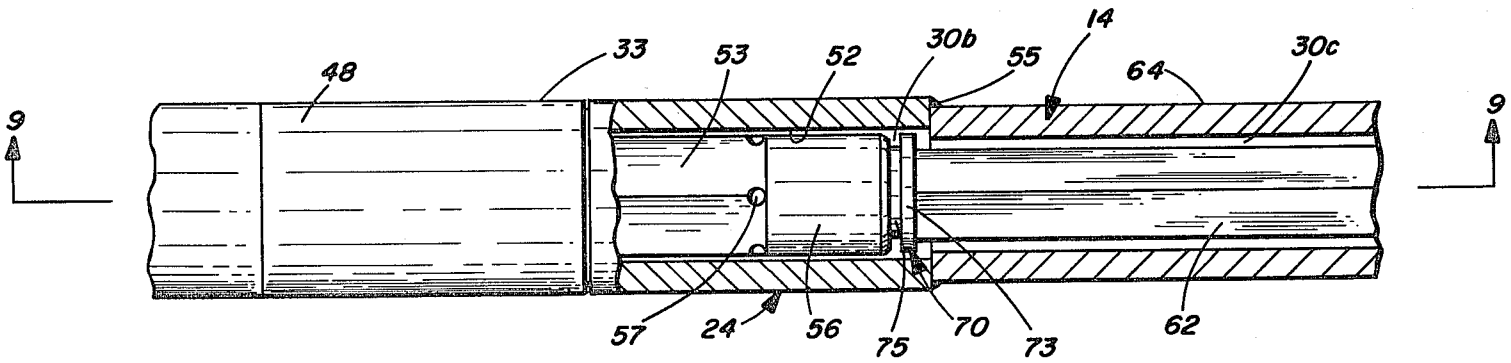
FIG. 8 is a fragmentary side elevation view partly in sections illustrating the coupling connection structure.

As best shown in FIGS. 2, 8 and 9, the first or lower stem section 16 includes two aligned outer pipes 32, 33 (may be formed as one) attached by a weld 34 to form a passage of constant diameter. An inner pipe 35 is spaced from and is concentric with the outer pipes 32, 33. The inner pipe 35 is polygonal (i.e. hexagonal) in cross-section (FIG. 3), and is attached at one end to the inner surface of the pipe 32 by a circumferential weld 36. An outer passage 30*a* extends between the inner pipe 35 and the outer pipes 32, 33 and forms a portion of the outer passage 30 for the compound stem 14. The inner pipe 35 has a central passage 26*a* which forms a portion of the inner passage 26 of the compound stem.

Figure 4:
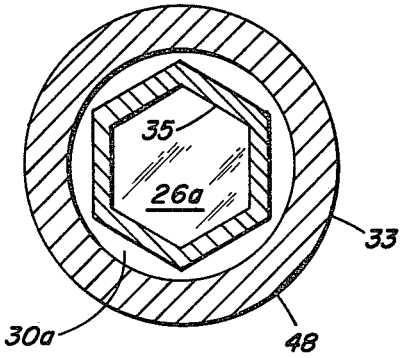
FIG. 4 is an enlarged cross-sectional view of the first drill stem section taken along line 4—4 of FIG. 2.
Figure 5:
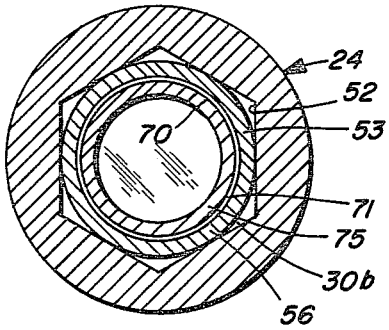
FIG. 5 is an enlarged cross-sectional view of the coupling connection structure taken along line 5—5 of FIG. 2.
Figure 6:
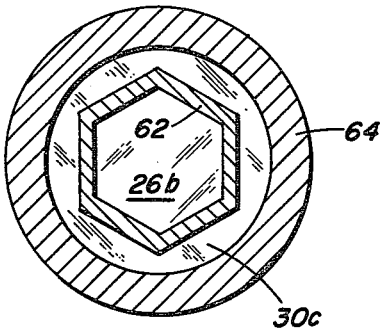
FIG. 6 is an enlarged cross-sectional view of a second drill stem section taken along line 6—6 of FIG. 2.
Figure 7:
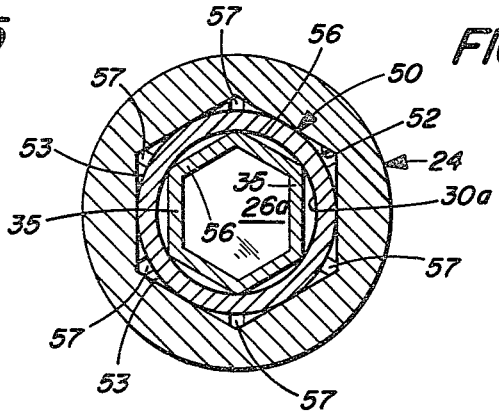
FIG. 7 is an enlarged cross-sectional view of the coupling structure and the first drill stem section taken along lines 7—7 of FIG. 2.

The outer pipe 32 has a prismatic surface 39 that is hexagonal in cross-section (FIG. 3) and received in a similarly shaped bore (not shown) in the drive shaft 22. The pipe 32 and the drive shaft 22 cooperate to transmit torque from the shaft to the pipe 32 so as to turn the compound stem 14 within a stationary swivel housing 40. The pipe 32 has a circular collar 42 that abuts an end of the drive shaft 22 to limit vertical movement of the pipe 32 in the bore and to apply drilling thrust to the drill bit 12. The other outer pipe 33 has a constant inner diameter with the outer surface portion 48 of the pipe 33 being circular in cross-section (FIGS. 4 and 8). Preferably, all the pipes have a circular outer surface configuration The housing 24 is fixedly attached to the second stem section 18 by a weld 55 (FIGS. 2 and 9) and has a prismatic inner surface 52 that is hexagonal in cross-section (FIGS. 5 and 7) and telescopically fit over a similarly shaped outer integral step surface 53 of the pipe 33. An O-ring 54 or similar type gasket fits between the housing 24 and the step surface of the inner pipe 33. The O-ring 54 should be of a flexible, high strength plastic or elastomeric (i.e. rubber material) and fits within a recess or groove 51 provided in a shoulder 50 formed in the outer surface 48 of the pipe 33, as best seen in FIG. 9. This provides a fluid seal between the stem sections 16 and 18 in the installed condition of the coupling. The prismatic surfaces 52, 53 facilitate attachment of the stem sections 16, 18 by eliminating pinning or other complicated coupling arrangements.

In the invention a reduced diameter sleeve 56 is attached (FIG. 9) to an end of the inner pipe 35 by a weld 58. The sleeve 56 is circular in cross-section and is concentric with the inner pipe 35 and is radially spaced from the coupling housing 24 to form a passage portion 30*b* (of the outer passage 30) between the sleeve 56 and housing 24. The passage 30*b* is connected in fluid communication with the outer passage 30*a* of the first stem section 16 by a series (i.e. six) holes 57 spaced circumferentially at an end portion of the hexagonal, step section 53 of inner pipe 33. By this arrangement, input fluid (i.e. water) is forced under pressure through the passages 30, 30*a* and 30*b* via holes 57 which are disposed at each of the apex edges defining the hexagonal surface of the integral step surface 53.

The second or upper stem section 18 has inner and outer concentric pipes 62, 64 that are radially spaced apart to form a passage portion 30*c* which is a extension of the outer passage 30 between them. Accordingly, the outer passage 30*c* is connected in fluid communication with the outer passage 30*a* of the first stem 16 a female nipple 70 attached thereto by a weld 72 section by the passage 30*b* provided in the coupling structure 20. One end of the inner pipe 62 has the nipple 70 for a collar 73 and an integral cylindrical shank 75. The shank 73 has a circular cross-section (FIG. 5) and is removedly and slidably received within the hollow sleeve 56. An O-ring 71 (rubber or plastic) fits within a groove 77 of sleeve 56 and acts as a seal to prevent undesired fluid communication between the outer passage 30 and the inner passage 26. The inner pipe 62 of the second section 18 has a central or inner passage 26*b* that forms a portion and continuation of the inner passage 26 of the compound stem 14. The passage 26*b* is connected in fluid communication with the central passage 26*a* of the first stem section 16 by hollow bores provided in the nipple 70.

In the embodiment shown, a drill bit seat 74 has a hollow bore (FIG. 1) and is attached to the free end of the second stem section 18 by weldmounts 76, 78. The drill bit 12 is removably attached to the bit seat 74 (as known in the art) and has a plurality of dust collection passageways 13 that communicate with a space 79 between the bit 12 and bit seat to provide a fluid communication between the cutting area 28, the hollow bore of the drill bit seat, and the inner passage portions 26*a*, 26*b* of the compound stem 14 via the coupling structure 20 of the invention During drilling, water enters a conventional type swivel housing 40 which allows the drill stem sections 16 and 18 to rotate while a water hose (not shown) connected to the housing remains stationary. The water then enters the compound stem 14 through an input orifice 80 (FIG. 1) in the first stem section 16 and travels up the compound stem through the outer passage 30 until it exits through a series (i.e. four) discharge openings 82 provided in the outer pipe 64 of the second stem section 18. The discharge openings 82 are preferably canted or inclined to induce direct the flow of water in an upward and outward direction. From this point, the water is drawn by the vacuum (via the inner passage 26) upwards to the cutting area 28 and to the bit 12. The water cools the bit, which causes the bit to retain its sharp edge longer. These and other advantages of this "DUST HOG" type bit are shown and described in applicants co-pending application Ser. No. 170,352 which is incorporated herein by reference. A slurry containing the water and accompanying cuttings from the drilling area 28 is then drawn through the dust collection holes 13 in the bit 12 and down the inner passage 26 of the compound stem 14 to a collection box (not shown) in which it is retained until a suitable place is encountered for its disposal.

While the preferred embodiment of the invention has been disclosed in detail, various modifications or alterations may be made therein without departing from the spirit or scope of the invention set forth in the appended claims.

What is claimed is:

1. In a compound drill stem having first and second, concurrently rotatable stem sections, each section including a pair of spaced inner and outer concentric pipes which define a central passage and an outer passage, the improvement comprising coupling means for connecting the sections, the means including two passages to establish fluid communication between the central passages of the sections and the outer passages of the sections, a surface of the outer pipe of the second stem section and a surface of the coupling means are each polygonal in cross-section and are telescopically fit together, the coupling means includes a sleeve attached to one of the inner pipes and within which the other inner pipe is removedly received, and the other inner pipe includes an attached collar that is removedly received within the sleeve.

2. A compound drill stem comprising:

(a) first and second rotatable stem section, each section including a pair of spaced inner and outer concentric pipes which define a central passage and an outer passage; and, (b) coupling means for connecting the first and second stem sections, the means including two passages to establish fluid communication between the central passages of the sections and between the outer passages of the sections, a surface of the outer pipe of the second section and a surface of the coupling means are each polygonal in cross-section and are telescopically fit together, the coupling means includes a sleeve attached to one of the inner pipes and within which the other inner pipe is removedly received, and the other inner pipe includes an attached collar that is removedly received within the sleeve.

* * * * *